US012065954B2

(12) United States Patent
Högström et al.

(10) Patent No.: US 12,065,954 B2
(45) Date of Patent: Aug. 20, 2024

(54) AFTERTREATMENT SYSTEM

(71) Applicant: VOLVO TRUCK CORPORATION, Gothenburg (SE)

(72) Inventors: Åsa Högström, Gothenburg (SE); Irman Svraka, Gothenburg (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 18/512,150

(22) Filed: Nov. 17, 2023

(65) Prior Publication Data

US 2024/0183304 A1 Jun. 6, 2024

(30) Foreign Application Priority Data

Dec. 5, 2022 (EP) ..... 22211405

(51) Int. Cl.
*F01N 11/00* (2006.01)
*F01N 3/20* (2006.01)

(52) U.S. Cl.
CPC ..... *F01N 11/007* (2013.01); *F01N 3/208* (2013.01); *F01N 2550/02* (2013.01); *F01N 2560/026* (2013.01); *F01N 2610/14* (2013.01); *F01N 2900/0601* (2013.01); *F01N 2900/1402* (2013.01); *F01N 2900/1404* (2013.01); *F01N 2900/1411* (2013.01)

(58) Field of Classification Search
CPC .... F01N 11/007; F01N 3/208; F01N 2550/02; F01N 2560/026; F01N 2610/14; F01N 2900/0601; F01N 2900/1402; F01N 2900/1404; F01N 2900/1411
See application file for complete search history.

(56) References Cited

U.S. PATENT DOCUMENTS

2010/0293925 A1 11/2010 Lahr et al.
2014/0144220 A1 5/2014 Ardanese et al.
2014/0223886 A1* 8/2014 Khaled ..... F01N 3/106 60/277

FOREIGN PATENT DOCUMENTS

EP 2025388 A1 2/2009
EP 2865859 A1 4/2015
EP 2529093 B1 5/2020

OTHER PUBLICATIONS

Extended European Search Report in corresponding European Application No. 22211405.0 dated Mar. 9, 2023 (7 pages).

* cited by examiner

*Primary Examiner* — Brandon D Lee
(74) *Attorney, Agent, or Firm* — Venable LLP; Jeffri A. Kaminski

(57) ABSTRACT

An aftertreatment system for a vehicle is connectable to an internal combustion engine The aftertreatment system includes an oxidation catalyst, a first NOx sensor arranged upstream the oxidation catalyst, a second NOx sensor arranged downstream the oxidation catalyst, and a control unit comprising a processor device configured to determine a sensor based conversion ratio of nitric oxides to nitrogen dioxides by the oxidation catalyst from data received from first and second NOx sensor, obtain an estimated conversion ratio of nitric oxides to nitrogen dioxides by the oxidation catalyst from a model, and determine a malfunction condition of the aftertreatment system in response to the sensor based conversion ratio being different from the estimated conversion ratio, and perform a responsive action of the aftertreatment system based on the malfunction condition.

18 Claims, 4 Drawing Sheets

AFTERTREATMENT SYSTEM

TECHNICAL FIELD

The inventive concept relates generally to aftertreatment technology. In particular aspects, the inventive concept relates to an aftertreatment system for a vehicle. The inventive concept can be applied in heavy-duty vehicles, such as trucks, buses, and construction equipment. Although the inventive concept may be described with respect to a particular vehicle, the inventive concept is not restricted to any particular vehicle.

BACKGROUND

Aftertreatment systems are conventionally incorporated downstream an internal combustion engine of a vehicle in order to reduce exhaustion of environmentally harmful gases to the ambient environment. The aftertreatment system may, for example, comprise an oxidation catalyst which is arranged to convert nitric oxides to nitrogen dioxides. A particle filter may also be provided further downstream the oxidation catalyst.

Due to various reasons, the oxidation catalyst may however not be able to convert nitric oxides to nitrogen dioxides to the extent expected. This can, for example, result in an incorrect supply of reducing agent into the aftertreatment system downstream the oxidation catalyst, thereby obtaining a less efficient reduction of environmentally harmful exhaust gases fed into the ambient environment. There is thus a desire to determine the operable functionality of an aftertreatment system.

SUMMARY

According to a first aspect of the inventive concept, there is provided an aftertreatment system for a vehicle, the aftertreatment system being connectable to an internal combustion engine, wherein the aftertreatment system comprises an oxidation catalyst, a first $NO_x$ sensor arranged upstream the oxidation catalyst, a second $NO_x$ sensor arranged downstream the oxidation catalyst, and a control unit comprising a processor device configured to receive data, from the first $NO_x$ sensor, indicative of a level of nitric oxides, NO, in exhaust gas from the internal combustion engine upstream the oxidation catalyst, receive data, from the second $NO_x$ sensor, indicative of a level of nitric oxides and nitrogen dioxides, NO2, in the exhaust gas downstream the oxidation catalyst, determine a sensor based conversion ratio of nitric oxides to nitrogen dioxides by the oxidation catalyst from the data received from the first and second $NO_x$ sensors, obtain an estimated conversion ratio of nitric oxides to nitrogen dioxides by the oxidation catalyst from a model operative to control a reducing agent injector, the model being representative of a plurality of conversion ratios, wherein each of the plurality of conversion ratios is associated with an exhaust gas condition of the exhaust gas from the internal combustion engine, determine a malfunction condition of the aftertreatment system in response to the sensor based conversion ratio being different from the estimated conversion ratio, and perform a responsive action of the aftertreatment system based on the malfunction condition.

The model operative to control the reducing agent injector will be described in further detail below but should be construed as a computer implement model defining an expected conversion ratio of nitric oxides to nitrogen dioxides in the oxidation catalyst based on various parameters. Thus, the model may advantageously estimate a level of nitric oxides and nitrogen dioxides in the exhaust gas after the exhaust gas has passed the oxidation catalyst, and to control a reducing agent injector to feed a suitable amount of reducing agent into the exhaust flow.

Further, the malfunction condition should preferably be construed as a malfunction of any component forming part of the aftertreatment system. Thus, a difference between the sensor based conversion ratio and the estimated conversion ratio may be caused for different reasons, i.e. different malfunctions, and a suitable or appropriate responsive action based on the specific malfunctioning condition can be taken.

The first aspect of the inventive concept may seek to solve the problem of aftertreatment systems not operable as expected. A technical benefit may include that malfunctions of different kind can be observed whereby an action can be taken. Various examples are presented in further detail below. Further, a malfunctioning condition can be observed while the vehicle, onto which the aftertreatment system is mounted, is operated, resulting in a rapid responsive action compared to detection of the malfunctioning condition during e.g. a vehicle maintenance event.

In some examples, the malfunction condition may comprise a first malfunction condition and a second malfunction condition, the aftertreatment system being exposed to the first malfunction condition when a difference between the sensor based conversion ratio and the estimated conversion ratio is below a predetermined threshold level, and exposed to the second malfunction condition when the difference between the sensor based conversion ratio and the estimated conversion ratio is above the predetermined threshold level. A technical benefit may include that different malfunction conditions require different responsive actions. Thus, a small difference between the sensor-based conversion ratio and the estimated conversion ratio may be caused by a malfunction condition resolvable without driving the vehicle to a maintenance repair shop, i.e., resolvable while driving, while a larger difference may require the vehicle operator to stop the vehicle or drive the vehicle to the closest maintenance repair shop.

In some examples, the processor device may be configured to, when the aftertreatment system is exposed to the first malfunction condition, perform a responsive action in the form of updating the estimated conversion ratio of the model to an updated conversion ratio, the updated conversion ratio corresponding to the sensor based conversion ratio. A technical benefit may include that the model can be up to date. For example, an aged oxidation catalyst may be deteriorated based on various conditions not accounted for by the model, and the model may hereby be calibrated to properly control the reducing agent.

In some examples, the processor device may be configured to, when the aftertreatment system is exposed to the second malfunction condition, perform a responsive action in the form of a component diagnostic analysis of at least one of the first $NO_x$ sensor, the second $NO_x$ sensor and the oxidation catalyst. When the aftertreatment system is exposed to the second malfunction condition, an adjustment of the model may not be sufficient as the difference between the sensor based conversion ratio and the estimated conversion ratio is considered too large. The component diagnostic analysis can be an on-board diagnosis, or diagnosis executed at a maintenance repair shop.

In some examples, the processor device may be further configured to determine a current exhaust gas condition of the exhaust gas from the internal combustion engine, and obtain the estimated conversion ratio of nitric oxides to nitrogen dioxides by the oxidation catalyst from a model for the current exhaust gas condition. A technical benefit may include that the current condition of the exhaust gas is compared to a corresponding condition defined by the model.

In some examples, the estimated conversion ratio of the model may be based on a number of operating cycles by the internal combustion engine. A technical benefit may include that the model can consider aging of the oxidation catalyst based on the operating cycles by the internal combustion engine.

In some examples, the estimated conversion ratio of the model may be based on a temperature level of the exhaust gas from the internal combustion engine for the number of operating cycles. A technical benefit may include that the model can consider aging of the oxidation catalyst based on the temperature levels it is exposed to during the operating cycles of the internal combustion engine. In particular, the model may consider time periods at which the oxidation catalyst has been exposed to temperature dependent stressful conditions.

In some examples, the exhaust gas condition may be a temperature and mass flow of the exhaust gas from the internal combustion engine.

In some examples, the oxidation catalyst may be a diesel oxidation catalyst.

In some examples, the aftertreatment system may further comprise a particle filter arranged downstream the oxidation catalyst. A technical benefit may include that the particle filter can perform active or passive soot generation before the combustion gas is exhausted to the ambient environment. In some examples, the particle filter may be a diesel particle filter.

In some examples, the second $NO_x$ sensor may be arranged downstream the particle filter. A technical benefit may include that an improved value for determining the amount of reducing agent to feed into a selective catalytic reduction device arranged downstream the particle filter.

In some examples, the processor device may be configured to, when the aftertreatment system is exposed to the second malfunction condition, perform a responsive action in the form of a component diagnostic analysis of the particle filter. A technical benefit may include that the operational functionality of the particle filter is evaluated/analyzed.

In some examples, the aftertreatment system may further comprise a selective catalytic reduction device arranged downstream the particle filter. A technical benefit may include that nitrogen oxides in the combustion gas downstream the oxidation catalyst can be converted into diatomic nitrogen and water, which are less environmentally harmful fluids. In some examples, the second $NO_x$ sensor may be arranged between the particle filter and the selective catalytic reduction device.

In some examples, the aftertreatment system further comprises a reducing agent injector arranged downstream the particle filter, the reducing agent injector is controlled by the model to feed reducing agent into the selective catalytic reduction device. A technical benefit may include that the reducing agent can improve NOx reduction in the selective catalytic reduction device.

In some examples, the aftertreatment system may further comprise a pre-selective catalytic reduction device arranged upstream the oxidation catalyst. A technical benefit may include that a lower amount of NOx must be converted by the oxidation catalyst.

In some examples, the first $NO_x$ sensor may be arranged upstream the pre-selective catalytic reduction device. A technical benefit may include that dosage of reducing agent into the pre-selective catalytic reduction device can be improved since a measured value from the NOx sensor can be construed as more accurate compared to a computer modelled value.

In some examples, the first $NO_x$ sensor may be arranged between the pre-selective catalytic reduction device and the oxidation catalyst.

According to a second aspect of the inventive concept, there is provided a vehicle comprising an internal combustion engine and an aftertreatment system according to any one of the examples described above in relation to the first aspect.

Effects and features of the second aspect are largely analogous to those described above in relation to the first aspect.

According to a third aspect of the inventive concept, there is provided a method of controlling an aftertreatment system for a vehicle, the method comprising determining, by a processor device of a computer system, a level of nitric oxides, NO, in exhaust gas from the internal combustion engine upstream an oxidation catalyst of the aftertreatment system, determining, by the processor device, a level of nitric oxides and nitrogen dioxides, NO2, in the exhaust gas downstream the oxidation catalyst, determining, by the processor device, a sensor based conversion ratio of nitric oxides to nitrogen dioxides by the oxidation catalyst based on the level of nitric oxides and nitrogen dioxides downstream the oxidation catalyst and the level of nitric oxides upstream the oxidation catalyst, determining, by the processor device, an estimated conversion ratio of nitric oxides to nitrogen dioxides by the oxidation catalyst from a model operative to control a reducing agent injector, the model being representative of a plurality of conversion ratios, wherein each of the plurality of conversion ratios is associated with an exhaust gas condition of the exhaust gas from the internal combustion engine, determining, by the processor device, a malfunction condition of the aftertreatment system in response to the sensor based conversion ratio being different from the estimated conversion ratio, and controlling, by the processor device, the aftertreatment system by performing a responsive action of the aftertreatment system based on the malfunction condition.

Effects and features of the third aspect are largely analogous to those described above in relation to the first aspect.

The above aspects, accompanying claims, and/or examples disclosed herein above and later below may be suitably combined with each other as would be apparent to anyone of ordinary skill in the art.

Additional features and advantages are disclosed in the following description, claims, and drawings, and in part will be readily apparent therefrom to those skilled in the art or recognized by practicing the inventive concept as described herein. There are also disclosed herein control units, computer readable media, and computer program products associated with the above discussed technical benefits.

BRIEF DESCRIPTION OF THE DRAWINGS

With reference to the appended drawings, below follows a more detailed description of aspects of the inventive concept cited as examples.

DETAILED DESCRIPTION

Aspects set forth below represent the necessary information to enable those skilled in the art to practice the inventive concept.

An object of the inventive concept described below may be to solve the problem of aftertreatment systems not operable as expected. A technical benefit may include that malfunctions of different kind can be observed whereby a suitable action can be taken.

Figure 1:
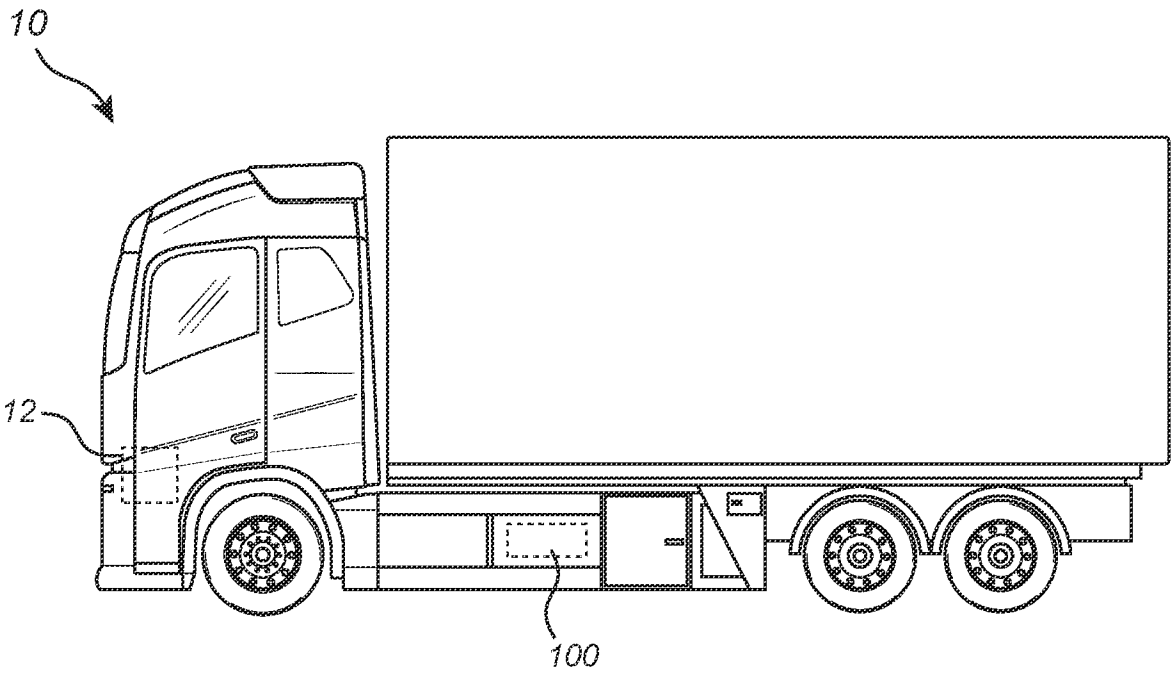
FIG. 1 is an exemplary illustration of a vehicle according to one example.

Turning to FIG. 1, which is a vehicle 10 according to one example. As depicted in FIG. 1, the vehicle 10 is exemplified as a truck. The vehicle 10 comprises an internal combustion engine 12 and an aftertreatment system 100. The aftertreatment system 100 is arranged downstream the internal combustion engine 12 to receive exhaust gases from the internal combustion engine 12.

Figure 2:
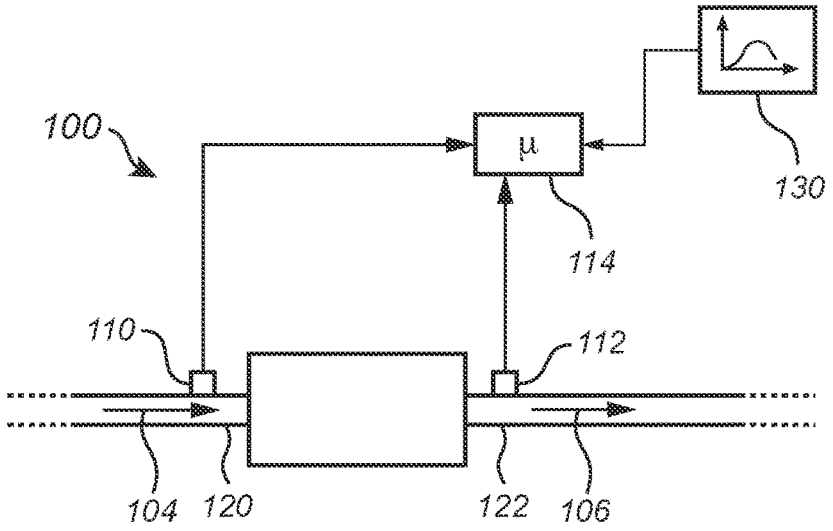
FIG. 2 is an exemplary illustration of an aftertreatment system according to one example.

In order to describe the aftertreatment system 100 in further detail, reference is made to FIG. 2. FIG. 2 is an exemplary illustration of an aftertreatment system 100 according to one example. The exemplified aftertreatment system 100 comprises an oxidation catalyst 102.

The oxidation catalyst 102 may be a diesel oxidation catalyst when the aftertreatment system 100 is connected downstream a diesel engine. Exhaust gases 104 is fed from the internal combustion engine and into the oxidation catalyst 102. The exhaust gases 104 contains nitric oxides, NO, before entering the oxidation catalyst 102. In the oxidation catalyst 104, at least a portion of the NO is oxidized into nitrogen dioxides, $NO_2$. Thus, the exhaust gases 106 fed from the oxidation catalyst 102 comprises a ratio of NO and $NO_2$. Put it differently, the oxidation catalyst 102 converts NO in the exhaust gases 104 into a molecular composition comprising NO and $NO_2$.

The aftertreatment system 100 further comprises a first $NO_x$ sensor 110 and a second $NO_x$ sensor 112. The first $NO_x$ sensor 110 is arranged upstream the oxidation catalyst 102. Thus, the exhaust gases 104 from the internal combustion engine 12 pass the first $NO_x$ sensor 110 before entering the oxidation catalyst 102. As exemplified in FIG. 2, the first $NO_x$ sensor 110 may be arranged in an inlet conduit 120 to the oxidation catalyst 102. The second $NO_x$ sensor 112 is arranged downstream the oxidation catalyst 102. Thus, the exhaust gases 106 fed from the oxidation catalyst 102 pass the second $NO_x$ sensor 112. As exemplified in FIG. 2, the second $NO_x$ sensor 112 may be arranged in an outlet conduit 122 from the oxidation catalyst 102. The first 110 and second 112 $NO_x$ sensors can detect/measure a quantity (preferably parts per million, ppm) of NO and $NO_2$ in the exhaust gases 104, 106. The quantity of NO and $NO_2$ is transmitted to a processor device of a control unit 114 of the aftertreatment system 100. In detail, the first 110 and second 112 $NO_x$ sensors transmit data which is displayed as a quantity of $NO_x$ in the exhaust gases 104, 106. In detail, the first and second $NO_x$ sensors measures a quantity of $NO_x$ which is indicative of a quantity of NO and $NO_2$. As a non-limiting example, one detected NO molecule may correspond to one $NO_x$ molecule, whilst one detected $NO_2$ molecule may be read as 0.8 NOx molecule. The first 110 and second 112 $NO_x$ sensors may thus be cross-sensitive to NO and $NO_2$, but at different levels. As the first $NO_x$ sensor 110 is arranged upstream the oxidation catalyst 102, it may be assumed that the measured quantity of $NO_x$ molecules in the exhaust gas 104 corresponds to the quantity of NO molecules, i.e. a 1:1 ratio.

The measured quantity of $NO_x$ gases by the second $NO_x$ sensor 112 can thus present an indication of the conversion ratio of NO to NO+$NO_2$. According to the above non-limiting example, if the first $NO_x$ sensor 110 reads 1000 ppm $NO_x$, and the second $NO_x$ sensor 112 reads 900 ppm $NO_x$, it can be assumed that exhaust gas 106 downstream the oxidation catalyst 102 contains a 50:50 ratio of NO and $NO_2$. In detail, when the first $NO_x$ sensor 110 reads 1000 ppm $NO_x$, this can be assumed to correspond to 1000 ppm NO. Since, as described above, the first 110 and second 112 $NO_x$ sensors may be cross-sensitive to NO and $NO_2$, the 900 ppm NOx may correspond to 500 ppm and 400 ppm NO2, but since, according to the present example, one $NO_2$ molecule may be read as 0.8 $NO_x$ molecules, the exhaust gases 106 contains in fact 500 ppm $NO_2$ and not 400 ppm as detected by the second $NO_x$ sensor 112.

The aftertreatment system 100 further comprises a model 130 operably connected to the processor device of the control unit 114. The model 130 is operable to control a reducing agent injector (see 406 in FIG. 4). In particular, the model 130 is operable to control a quantity of reducing agent fed into the aftertreatment system 100 at a position downstream the oxidation catalyst 102. Preferably, the model 130 is a computer model configured to estimate an expected conversion ratio of NO to $NO_2$ by the oxidation catalyst 102. The estimated conversion ratio is transmitted to the processor device of the control unit 114. By estimating the conversion ratio of the oxidation catalyst 102, a quantity of $NO_2$ entering e.g. a particle filter downstream the oxidation catalyst 102 can be estimated, whereby a suitable quantity of reducing agent can be fed into the aftertreatment system 100.

Further, the model 130 represents a plurality of conversion ratios. Each of the plurality of conversion ratios is associated with an exhaust gas condition of the exhaust gas 104 from the internal combustion engine 12. Thus, for a certain condition of the exhaust gas 104 an estimated conversion ratio is determined by the model 130, i.e. a current exhaust gas condition of the exhaust gas 104 from the internal combustion engine 12 is determined whereby the estimated conversion ratio of NO to $NO_2$ by the oxidation catalyst 102 for the current exhaust gas condition is obtained from the model. The exhaust gas condition may comprise a different engine conditions, such as, but not limited to, e.g. temperature and mass flow of the exhaust gas from the internal combustion engine. Thus, for different engine conditions, the model may estimate different conversion ratios.

The model 130 may also take aging of the oxidation catalyst into account when estimating a current conversion ratio. In detail, the conversion ratio estimated by the model 130 may be based on the number of operating cycles by the internal combustion engine 12. Hence, the processor device of the control unit 114 may receive details of the operating cycles of the internal combustion engine 12 which is take into account by the model 130 when estimating the conversion ratio. Also, the temperature level of the exhaust gas 104 for the different operating cycles may be taken into account when the model 130 estimates the conversion ratio. In particular, an oxidation catalyst exposed to a high number of operating cycles, and high stressful temperature levels may have a tendency to deteriorate compared to a new and unused oxidation catalyst 102. Thus, for an older oxidation catalyst, the conversion ratio may be lower compared to a newer oxidation catalyst 102.

By means of the above description, the processor device of the control unit 114 can hereby determine a sensor based conversion ratio of NO to $NO_2$ by the oxidation catalyst 102 from the data received from the first 110 and second 112 NOx sensors, as well as to obtain an estimated conversion ratio of NO to $NO_2$ from the model 130.

Figure 3:
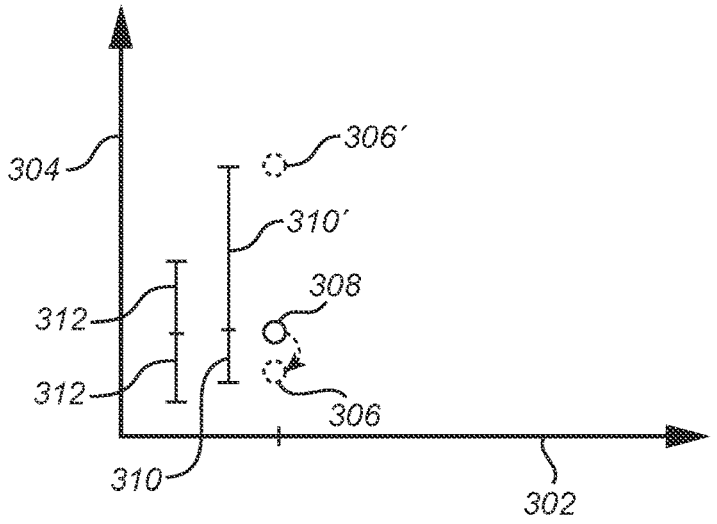
FIG. 3 is an example of a graph illustrating sensor based conversion ratio and estimated conversion ratio according to one example.

In order to describe the operation of the aftertreatment system 100 according to one example, reference is made to FIG. 2 in combination with FIG. 3. FIG. 3 illustrates an example of a graph illustrating sensor based conversion ratio and estimated conversion ratio according to one example. The horizontal axis 302 represents the exhaust gas condition of the exhaust gas from the internal combustion engine 12, while the vertical axis 304 represents the conversion ratio of NO to $NO_2$ by the oxidation catalyst 102.

During operation of the vehicle 10, when the vehicle 10 is propelled by the internal combustion engine 12, exhaust gases 104 is fed to the oxidation catalyst 102 as detailed above. The processor device of the control unit 114 receives data from each of the first 110 and second 112 NOx sensors and determines a sensor based conversion ratio 306 of NO to $NO_2$ by the oxidation catalyst 102. For the same exhaust gas condition, the processor device obtains an estimated conversion ratio 308 from the model 130. As can be seen in FIG. 3, the sensor based conversion ratio 306 is lower compared to the estimated conversion ratio 308. Since the sensor based conversion ratio 306 is different from the estimated conversion ratio 308, the processor device of the control unit 114 determines a malfunctioning condition of the aftertreatment system 100. In other words, there is some sort of malfunction of the aftertreatment system 100 as the sensor based conversion ratio 306 differs from the estimated conversion ratio 308 and a responsive action is performed.

In the illustrated example of FIG. 3, the difference 310 is below a predetermined threshold level 312. The malfunctioning condition may hereby be classified as a first malfunctioning condition. Put it differently, the aftertreatment system 100 is exposed to the first malfunctioning condition when the difference 310 is below the predetermined threshold level 312.

When the aftertreatment system 100 is exposed to the first malfunction condition, the processor device of the control unit 114 performs a responsive action in the form of updating 314 the estimated conversion ratio of the model 130 to an updated conversion ratio. The updated conversion ratio thus corresponds to the sensor based conversion ratio 306. Accordingly, the model 130 is updated for subsequent operation of the vehicle 10.

FIG. 3 also exemplifies another scenario where the sensor based conversion ratio 306' is substantially higher compared to the estimated conversion ratio 308 from the model 130. A difference 310' between the estimated conversion ratio 308 and the sensor based conversion ratio 306' is above, i.e. larger, than the predetermined threshold level 312. The malfunctioning condition may hereby be classified as a second malfunctioning condition. Put it differently, the aftertreatment system 100 is exposed to the second malfunctioning condition when the difference 310' is above the predetermined threshold level 312.

When the aftertreatment system 100 is exposed to the second malfunctioning condition, the processor device of the control unit 114 may determine that the difference between the sensor based conversion ratio 306' and the estimated conversion ratio 308 is too severe for an update of the model 130 to be appropriate. A different responsive action compared to the responsive action when the aftertreatment system 100 was exposed to the first malfunction condition should preferably be performed. Preferably, the processor device may be configured to perform a responsive action in the form of a component diagnostic analysis of at least one of the first NOx sensor 110, the second NOx sensor 112 and the oxidation catalyst 102. When exposed to the second malfunctioning condition, it is more likely that there is an error or malfunction of the hardware compared to the model 130.

Figure 4:
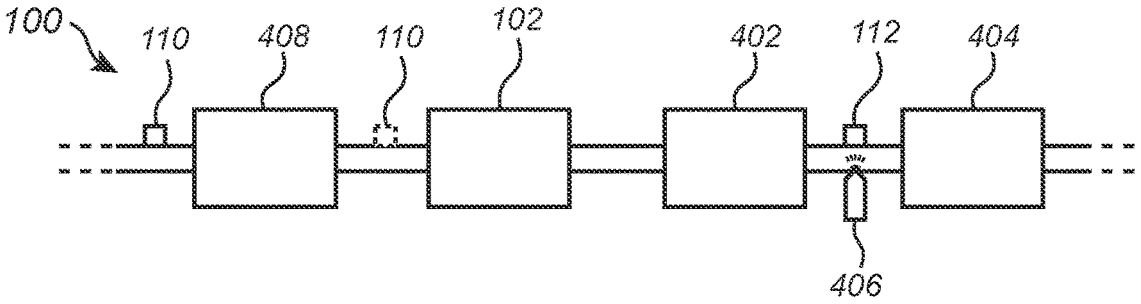
FIG. 4 is an exemplary illustration of an aftertreatment system according to one example.

Turning now to FIG. 4 which is an exemplary illustration of an aftertreatment system 100 according to one example. As exemplified in FIG. 4, the aftertreatment system 100 further comprises a particle filter 402 arranged downstream the oxidation catalyst 102. The particle filter 402, also referred to as a particulate filter, which preferably may be a diesel particle filter, is arranged to remove soot from the exhaust gas. As can be seen in the FIG. 4 example, the second $NO_x$ sensor 112 is arranged downstream the particle filter 402.

As an alternative or complement to the above description, processor device may also be configured to, when the aftertreatment system 100 is exposed to the second malfunction condition, perform a responsive action in the form of a component diagnostic analysis of the particle filter 402.

The aftertreatment system 100 exemplified in FIG. 4 also comprises a selective catalytic reduction device 404 arranged downstream the particle filter 402. The second $NO_x$ sensor 112 is thus preferably arranged between the particle filter 402 and the selective catalytic reduction device 404. Also, the aftertreatment system 100 further comprises a reducing agent injector 406. The reducing agent injector is arranged downstream the particle filter 402. As briefly described above, the reducing agent injector 406 is controlled by the model 130 to feed reducing agent into aftertreatment system 100. More particularly, the reducing agent injector 406 may be controlled by the model 130 to feed reducing agent into the selective catalytic reduction device 404. Passive soot regeneration is thus obtained by the particle filter, while reducing agent is fed into the aftertreatment system downstream the particle filter such that $NO_x$ can be converted in the selective catalytic reduction device 404.

The exemplified aftertreatment system 100 in FIG. 4 also comprises a pre-selective catalytic reduction device 408 arranged upstream the oxidation catalyst 102. The first $NO_x$ sensor 110 may be arranged upstream the pre-selective catalytic reduction device 408, or as an option be arranged between the pre-selective catalytic reduction device 408 and the oxidation catalyst 102.

Figure 5:
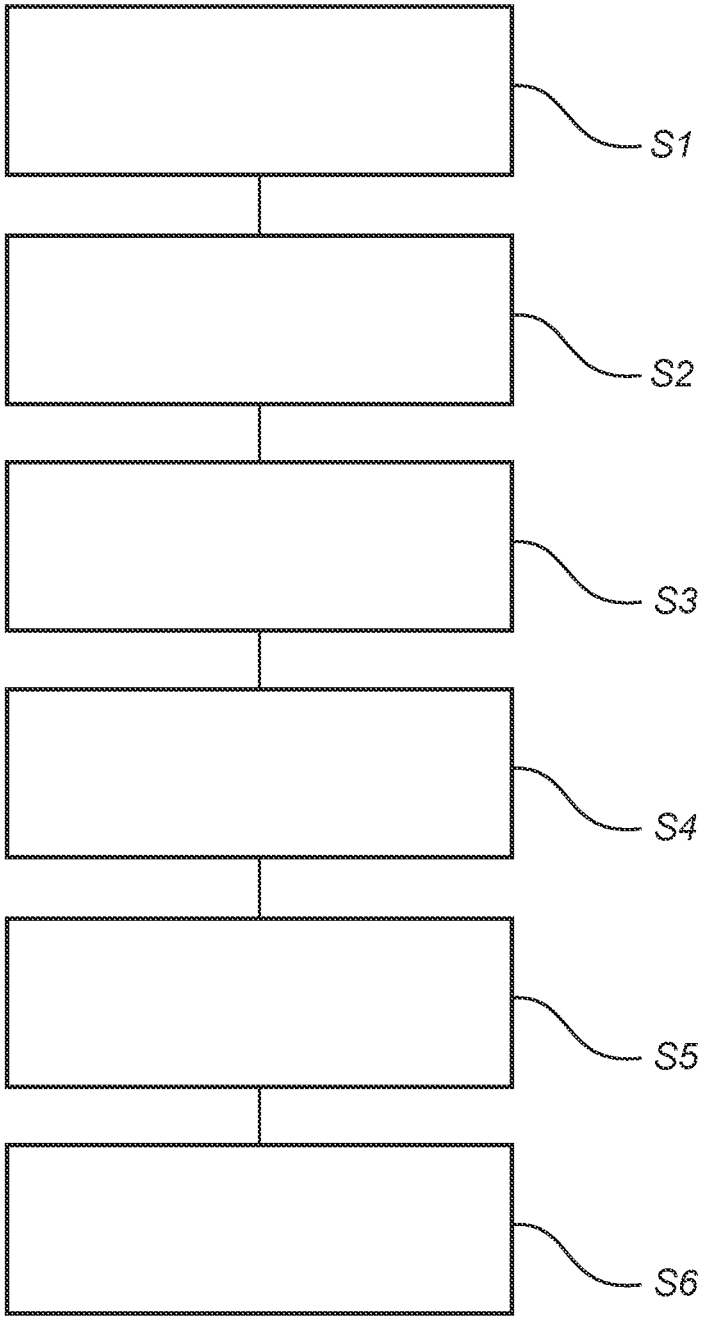
FIG. 5 is a flow chart of a method of controlling an aftertreatment system according to one example.

Reference is now made to FIG. 5 which is a flow chart of a method of controlling an aftertreatment system 100 according to one example. As described above, during operation, the processor device determines S1 a level of NO in exhaust gas from the internal combustion engine upstream the oxidation catalyst 102. The processor device also determines S2 a level of NO2 in the exhaust gas downstream the oxidation catalyst. The processor device hereby determines S3 a sensor based conversion ratio of NO to $NO_2$ by the oxidation catalyst 102 based on the level of NO and $NO_2$ downstream the oxidation catalyst 102 and the level of NO upstream the oxidation catalyst 102.

The processor device also determines S4 an estimated conversion ratio of NO to $NO_2$ by the oxidation catalyst from the model 130 operative to control the reducing agent injector 406. As described above, the model 130 is representative of a plurality of conversion ratios, wherein each of the plurality of conversion ratios is associated with an exhaust gas condition of the exhaust gas from the internal combustion engine 12.

Moreover, the processor device determines S5 a malfunction condition of the aftertreatment system 100 when the sensor based conversion ratio is different from the estimated conversion ratio. Based on the malfunctioning condition, the processor device controls S6 the aftertreatment system 100 to perform a responsive action as described above.

Figure 6:
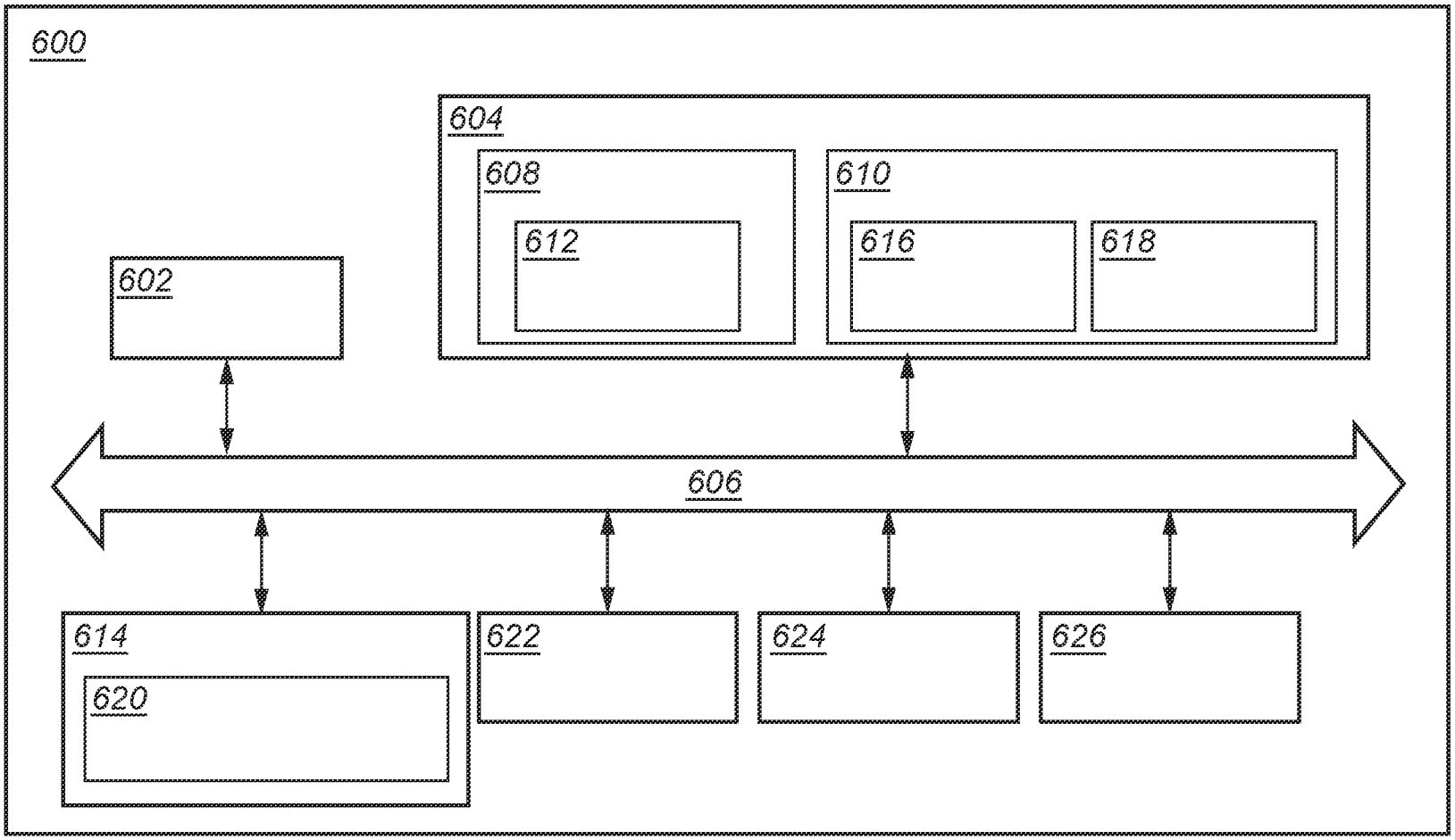
FIG. 6 is schematic diagram of an exemplary computer system for implementing examples disclosed herein, according to one example.

Turning now to FIG. 6 which is a schematic diagram of a computer system 600 for implementing examples disclosed herein. The computer system 600 is adapted to execute instructions from a computer-readable medium to perform these and/or any of the functions or processing described herein. The computer system 600 may be connected (e.g., networked) to other machines in a LAN, an intranet, an extranet, or the Internet. While only a single device is illustrated, the computer system 600 may include any collection of devices that individually or jointly execute a set (or multiple sets) of instructions to perform any one or more of the methodologies discussed herein. Accordingly, any reference in the disclosure and/or claims to a computer system, computing system, computer device, computing device, control system, control unit, electronic control unit (ECU), processor device, etc., includes reference to one or more such devices to individually or jointly execute a set (or multiple sets) of instructions to perform any one or more of the methodologies discussed herein. For example, control system may include a single control unit or a plurality of control units connected or otherwise communicatively coupled to each other, such that any performed function may be distributed between the control units as desired. Further, such devices may communicate with each other or other devices by various system architectures, such as directly or via a Controller Area Network (CAN) bus, etc.

The computer system 600 may comprise at least one computing device or electronic device capable of including firmware, hardware, and/or executing software instructions to implement the functionality described herein. The computer system 600 may include a processor device 602 (may also be referred to as a control unit), a memory 604, and a system bus 606. The computer system 600 may include at least one computing device having the processor device 602. The system bus 606 provides an interface for system components including, but not limited to, the memory 604 and the processor device 602. The processor device 602 may include any number of hardware components for conducting data or signal processing or for executing computer code stored in memory 604. The processor device 602 (e.g., control unit) may, for example, include a general-purpose processor, an application specific processor, a Digital Signal Processor (DSP), an Application Specific Integrated Circuit (ASIC), a Field Programmable Gate Array (FPGA), a circuit containing processing components, a group of distributed processing components, a group of distributed computers configured for processing, or other programmable logic device, discrete gate or transistor logic, discrete hardware components, or any combination thereof designed to perform the functions described herein. The processor device may further include computer executable code that controls operation of the programmable device.

The system bus 606 may be any of several types of bus structures that may further interconnect to a memory bus (with or without a memory controller), a peripheral bus, and/or a local bus using any of a variety of bus architectures. The memory 604 may be one or more devices for storing data and/or computer code for completing or facilitating methods described herein. The memory 604 may include database components, object code components, script components, or other types of information structure for supporting the various activities herein. Any distributed or local memory device may be utilized with the systems and methods of this description. The memory 604 may be communicably connected to the processor device 602 (e.g., via a circuit or any other wired, wireless, or network connection) and may include computer code for executing one or more processes described herein. The memory 604 may include non-volatile memory 608 (e.g., read-only memory (ROM), erasable programmable read-only memory (EPROM), electrically erasable programmable read-only memory (EEPROM), etc.), and volatile memory 610 (e.g., random-access memory (RAM)), or any other medium which can be used to carry or store desired program code in the form of machine-executable instructions or data structures and which can be accessed by a computer or other machine with a processor device 602. A basic input/output system (BIOS) 612 may be stored in the non-volatile memory 608 and can include the basic routines that help to transfer information between elements within the computer system 600.

The computer system 600 may further include or be coupled to a non-transitory computer-readable storage medium such as the storage device 614, which may comprise, for example, an internal or external hard disk drive (HDD) (e.g., enhanced integrated drive electronics (EIDE) or serial advanced technology attachment (SATA)), HDD (e.g., EIDE or SATA) for storage, flash memory, or the like. The storage device 614 and other drives associated with computer-readable media and computer-usable media may provide non-volatile storage of data, data structures, computer-executable instructions, and the like.

A number of modules can be implemented as software and/or hard-coded in circuitry to implement the functionality described herein in whole or in part. The modules may be stored in the storage device 614 and/or in the volatile memory 610, which may include an operating system 616 and/or one or more program modules 618. All or a portion of the examples disclosed herein may be implemented as a computer program product 620 stored on a transitory or non-transitory computer-usable or computer-readable storage medium (e.g., single medium or multiple media), such as the storage device 614, which includes complex programming instructions (e.g., complex computer-readable program code) to cause the processor device 602 to carry out the steps described herein. Thus, the computer-readable program code can comprise software instructions for implementing the functionality of the examples described herein when executed by the processor device 602. The processor device 602 may serve as a controller or control system for the computer system 600 that is to implement the functionality described herein.

The computer system 600 also may include an input device interface 622 (e.g., input device interface and/or output device interface). The input device interface 622 may be configured to receive input and selections to be communicated to the computer system 600 when executing instructions, such as from a keyboard, mouse, touch-sensitive surface, etc. Such input devices may be connected to the processor device 602 through the input device interface 622 coupled to the system bus 606 but can be connected through other interfaces such as a parallel port, an Institute of Electrical and Electronic Engineers (IEEE) 1394 serial port, a Universal Serial Bus (USB) port, an IR interface, and the like. The computer system 600 may include an output device interface 624 configured to forward output, such as to a display, a video display unit (e.g., a liquid crystal display (LCD) or a cathode ray tube (CRT)). The computer system 600 may also include a communications interface 626 suitable for communicating with a network as appropriate or desired.

The operational steps described in any of the exemplary aspects herein are described to provide examples and discussion. The steps may be performed by hardware components, may be embodied in machine-executable instructions to cause a processor to perform the steps, or may be performed by a combination of hardware and software. Although a specific order of method steps may be shown or described, the order of the steps may differ. In addition, two or more steps may be performed concurrently or with partial concurrence.

The terminology used herein is for the purpose of describing particular aspects only and is not intended to be limiting of the disclosure. As used herein, the singular forms "a," "an," and "the" are intended to include the plural forms as well, unless the context clearly indicates otherwise. As used herein, the term "and/or" includes any and all combinations of one or more of the associated listed items. It will be further understood that the terms "comprises," "comprising." "includes," and/or "including" when used herein specify the presence of stated features, integers, steps, operations, elements, and/or components, but do not preclude the presence or addition of one or more other features, integers, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present inventive concept.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this inventive concept belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present inventive concept is not limited to the aspects described above and illustrated in the drawings; rather, the skilled person will recognize that many changes and modifications may be made within the scope of the present inventive concept and appended claims. In the drawings and specification, there have been disclosed aspects for purposes of illustration only and not for purposes of limitation, the scope of the inventive concepts being set forth in the following claims.

The invention claimed is:

1. An aftertreatment system for a vehicle, the aftertreatment system being connectable to an internal combustion engine, wherein the aftertreatment system comprises:

an oxidation catalyst, a first $NO_x$ sensor arranged upstream the oxidation catalyst, a second $NO_x$ sensor arranged downstream the oxidation catalyst, and a control unit comprising a processor device configured to:

receive data, from the first $NO_x$ sensor, indicative of a level of nitric oxides, NO, in exhaust gas from the internal combustion engine upstream the oxidation catalyst, receive data, from the second $NO_x$ sensor, indicative of a level of nitric oxides and nitrogen dioxides, NO2, in the exhaust gas downstream the oxidation catalyst, determine a sensor based conversion ratio of nitric oxides to nitrogen dioxides by the oxidation catalyst from the data received from the first and second $NO_x$ sensors, obtain an estimated conversion ratio of nitric oxides to nitrogen dioxides by the oxidation catalyst from a model operative to control a reducing agent injector, the model being representative of a plurality of conversion ratios, wherein each of the plurality of conversion ratios is associated with an exhaust gas condition of the exhaust gas from the internal combustion engine, determine a malfunction condition of the aftertreatment system in response to the sensor based conversion ratio being different from the estimated conversion ratio, and perform a responsive action of the aftertreatment system based on the malfunction condition, wherein the malfunction condition comprises a first malfunction condition and a second malfunction condition, the aftertreatment system being exposed to the first malfunction condition when a difference between the sensor based conversion ratio and the estimated conversion ratio is below a predetermined threshold level, and exposed to the second malfunction condition when the difference between the sensor based conversion ratio and the estimated conversion ratio is above the predetermined threshold level, wherein the processor device is configured to, when the aftertreatment system is exposed to the first malfunction condition, perform the responsive action in the form of updating the estimated conversion ratio of the model to an updated conversion ratio, the updated conversion ratio corresponding to the sensor based conversion ratio, and wherein the exhaust gas condition is a temperature and mass flow of the exhaust gas from the internal combustion engine.

2. The aftertreatment system of claim 1, wherein the processor device is configured to, when the aftertreatment system is exposed to the second malfunction condition, perform the responsive action in the form of a component diagnostic analysis of at least one of the first $NO_x$ sensor, the second $NO_x$ sensor and the oxidation catalyst.

3. The aftertreatment system of claim 1, wherein the processor device is further configured to:

determine a current exhaust gas condition of the exhaust gas from the internal combustion engine, and obtain the estimated conversion ratio of nitric oxides to nitrogen dioxides by the oxidation catalyst from a model for the current exhaust gas condition.

4. The aftertreatment system of claim 1, wherein the estimated conversion ratio of the model is based on a number of operating cycles by the internal combustion engine.

5. The aftertreatment system of claim 4, wherein the estimated conversion ratio of the model is based on a temperature level of the exhaust gas from the internal combustion engine for the number of operating cycles.

6. The aftertreatment system of claim 1, wherein the oxidation catalyst is a diesel oxidation catalyst.

7. The aftertreatment system of claim 1, wherein the aftertreatment system further comprises a particle filter arranged downstream the oxidation catalyst.

8. The aftertreatment system of claim 7, wherein the particle filter is a diesel particle filter.

9. The aftertreatment system of claim 7, wherein the second $NO_x$ sensor is arranged downstream the particle filter.

10. The aftertreatment system of claim 9, wherein the processor device is configured to, when the aftertreatment system is exposed to the second malfunction condition, perform a responsive action in the form of a component diagnostic analysis of the particle filter.

11. The aftertreatment system of claim 7, wherein the aftertreatment system further comprises a selective catalytic reduction device arranged downstream the particle filter.

12. The aftertreatment system of claim 11, wherein the second $NO_x$ sensor is arranged between the particle filter and the selective catalytic reduction device.

13. The aftertreatment system of claim 11, wherein the aftertreatment system further comprises the reducing agent injector arranged downstream the particle filter, the reducing agent injector is controlled by the model to feed reducing agent into the selective catalytic reduction device.

14. The aftertreatment system of claim 1, wherein the aftertreatment system further comprises a pre-selective catalytic reduction device arranged upstream the oxidation catalyst.

15. The aftertreatment system of claim 14, wherein the first $NO_x$ sensor is arranged upstream the pre-selective catalytic reduction device.

16. The aftertreatment system of claim 14, wherein the first $NO_x$ sensor is arranged between the pre-selective catalytic reduction device and the oxidation catalyst.

17. A vehicle comprising an internal combustion engine and an aftertreatment system according to claim 1.

18. A method of controlling an aftertreatment system for a vehicle, the method comprising:

determining, by a processor device of a computer system, a level of nitric oxides, NO, in exhaust gas from the internal combustion engine upstream an oxidation catalyst of the aftertreatment system, determining, by the processor device, a level of nitric oxides and nitrogen dioxides, NO2, in the exhaust gas downstream the oxidation catalyst, determining, by the processor device, a sensor based conversion ratio of nitric oxides to nitrogen dioxides by the oxidation catalyst based on the level of nitric oxides and nitrogen dioxides downstream the oxidation catalyst and the level of nitric oxides upstream the oxidation catalyst, determining, by the processor device, an estimated conversion ratio of nitric oxides to nitrogen dioxides by the oxidation catalyst from a model operative to control a reducing agent injector, the model being representative of a plurality of conversion ratios, wherein each of the plurality of conversion ratios is associated with an exhaust gas condition of the exhaust gas from the internal combustion engine, determining, by the processor device, a malfunction condition of the aftertreatment system in response to the sensor based conversion ratio being different from the estimated conversion ratio, and controlling, by the processor device, the aftertreatment system by performing a responsive action of the aftertreatment system based on the malfunction condition, wherein the malfunction condition comprises a first malfunction condition and a second malfunction condition, the aftertreatment system being exposed to the first malfunction condition when a difference between the sensor based conversion ratio and the estimated conversion ratio is below a predetermined threshold level, and exposed to the second malfunction condition when the difference between the sensor based conversion ratio and the estimated conversion ratio is above the predetermined threshold level, wherein the processor device is configured to, when the aftertreatment system is exposed to the first malfunction condition, perform the responsive action in the form of updating the estimated conversion ratio of the model to an updated conversion ratio, the updated conversion ratio corresponding to the sensor based conversion ratio, and wherein the exhaust gas condition is a temperature and mass flow of the exhaust gas from the internal combustion engine.

* * * * *